US006283794B1

(12) United States Patent
Osuga

(10) Patent No.: US 6,283,794 B1
(45) Date of Patent: Sep. 4, 2001

(54) CONNECTOR FOR ELECTRICAL FUSE IGNITION DEVICE

(75) Inventor: Takehiko Osuga, Kanagawa Prefecture (JP)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/544,374

(22) Filed: Apr. 6, 2000

(30) Foreign Application Priority Data

Apr. 8, 1999 (JP) ..... 11-101430

(51) Int. Cl.[7] ..... H01R 33/66
(52) U.S. Cl. ..... 439/620; 439/752.5
(58) Field of Search ..... 439/620, 546, 439/547, 607, 610, 408–411

(56) References Cited

U.S. PATENT DOCUMENTS 3,850,498 * 11/1974 Schor ..... 439/620
4,443,050 * 4/1984 Taylor ..... 439/620
4,846,701 * 7/1989 Hayes et al. ..... 439/620
5,087,212 * 2/1992 Hanami ..... 439/620
5,102,354 * 4/1992 Crane et al. ..... 439/620
5,586,902 * 12/1996 Hopf et al. ..... 439/352

* cited by examiner

*Primary Examiner*—Neil Abrams
*Assistant Examiner*—J. F. Duverne
(74) *Attorney, Agent, or Firm*—Perman & Green, LLP

(57) ABSTRACT

The present invention has the aim of resolving the problem that there is a possibility of mistakes in wiring of connectors (1) not being discovered normally. A connector (1) for an electrical fuse ignition device comprising a pair of connector conductors (50, 51)adapted to grip a pair of leads (10, 11); a ferrite member (40) having a pair of through holes for accommodating the vicinities of one end of the pair of connector conductors (50, 51); and a connector trunk portion (70) having a pair of axially aligned holes (71, 72) for accommodating the vicinities of the other end of the connector conductors (50, 51), the connector (1) being characterized in that the shapes of said pair of connector conductors (50, 51) are non-identical such that the distance between the leads gripped when the other ends of said connector conductors (50, 51) are inserted into the axially-aligned holes (71, 72) of the connector trunk portion (70) is different from the distance between said axially-aligned holes (70, 71); and the distance between the pair of through holes provided in said ferrite member (40) is roughly equal to the distance between the leads (10, 11) when the connector conductors (50, 51) are inserted into the axially-aligned holes (71, 72) of said connector trunk portion (70).

26 Claims, 5 Drawing Sheets

CONNECTOR FOR ELECTRICAL FUSE IGNITION DEVICE

TECHNICAL FIELD OF THE INVENTION

The present invention relates to an electrical connector for an electrical fuse ignition device which instantly activates a so-called airbag or the like. More specifically, the present invention relates to a connector for electrically connecting an electrical initiating device side with an electrical system side which supplies the initiating device with an electrical current.

CONVENTIONAL ART

So-called airbags are used as one type of passenger protection apparatus for vehicle collisions. An airbag, for example, can be a bag (airbag) composed of flexible materials accommodated in the vicinity of the central portion of a steering wheel, which instantly fills with gas in the event of a collision or the like so as to prevent the passengers from sustaining impacts or flying out.

In order to instantly fill the airbag with gas, an explosive mixture is used, and an electrical fuse ignition device is used to ignite this mixture when required. Generally, the electrical system of the vehicle such as a battery or the like is used as the power supply to the electrical fuse, so that the fuse, upon being electrified, is instantly heated and detonates the mixture. Additionally, a sensor is provided in the circuit between the electrical system which is the power supply and the electric fuse, the sensor ordinarily cutting off the circuit, but upon detecting an acceleration of above a predetermined value or the like, turning on the power supply line and supplying a current to the ignition device.

According to a typical structure of a driver protection apparatus using an airbag, the folded airbag, explosive mixture and electrical fuse ignition device are housed in the vicinity of the steering wheel axis, while the sensor is located in the wiring connected to the vehicle electrical system in the vicinity of the central potion of the vehicle body. The wiring which connects to the electrical system from the battery via the sensor passes through the steering column and is connected by means of a connector in the vicinity of the central portion of the steering wheel to reach the electrical fuse ignition device.

While airbags must work reliably in the event of an emergency such as a collision, they ordinarily have absolutely no opportunity for operation from day to day. Additionally, it is dangerous for the airbag to be activated accidentally when there is no emergency. In order specifically to prevent accidental triggering, the effect of external electromagnetic waves is often eliminated by covering the connecting portions of the connectors with ferrite or the like so that an unexpected current will not be induced by the wiring to the ignition device reacting to electromagnetic waves, microwaves and the like.

PROBLEMS TO BE SOLVED BY THE INVENTION

Here, the problem lies in that whereas the airbag must work reliably in the case of an emergency but must not be activated otherwise, there is the possibility of faulty connections in the connector not being discovered during ordinary times. In order to resolve this problem, care has been taken so as to prevent mistakes when making connections by color-coding the leads protruding from the ignition device toward the connector, but this has not been sufficient to completely eliminate the possibility of wiring errors.

MEANS FOR RESOLVING THE PROBLEMS

The present invention has the object of resolving the above-described problems, and offers a connector for an electrical fuse ignition device wherein the shapes of the connector conductors which grip and electrically connect the free ends of a pair of wires protruding from the electrical fuse ignition device have different shapes to the left and right, and the distances between the holes respectively provided in the ferrite member for accommodating one end of said conductors and in the connector trunk portion for accommodating the other end are different. The present invention further offers a connector wherein a projecting portion is provided in the vicinity of the mouth portion of the connector member so that the projecting portion interferes to make it impossible to insert the connector conductors if the axially-aligned holes in the connector trunk portion into which the connector conductors are to be inserted are not correct.

EFFECTS OF THE INVENTION

When the connector according to the present invention is used, if an attempt is made to mistakenly connect a lead which is different from a predetermined lead to the connector, the distance between the terminals and the distance between the terminal receiving holes will not match, thus making it impossible to make the connection. As a result, it is possible to completely eliminate errors in which the leads are mistakenly connected in an reversed manner. Furthermore, in the case of a connector provided with a projecting portion in the connector trunk portion, the projecting portion will interfere to obstruct insertion unless the relationship between the connector conductors and the axially-aligned holes into which they are to be inserted is correct, thereby even more completely eliminating connection errors.

EMBODIMENTS OF THE INVENTION

Herebelow, embodiments of the present invention shall be described in detail with reference to the drawings.

Figure 1:
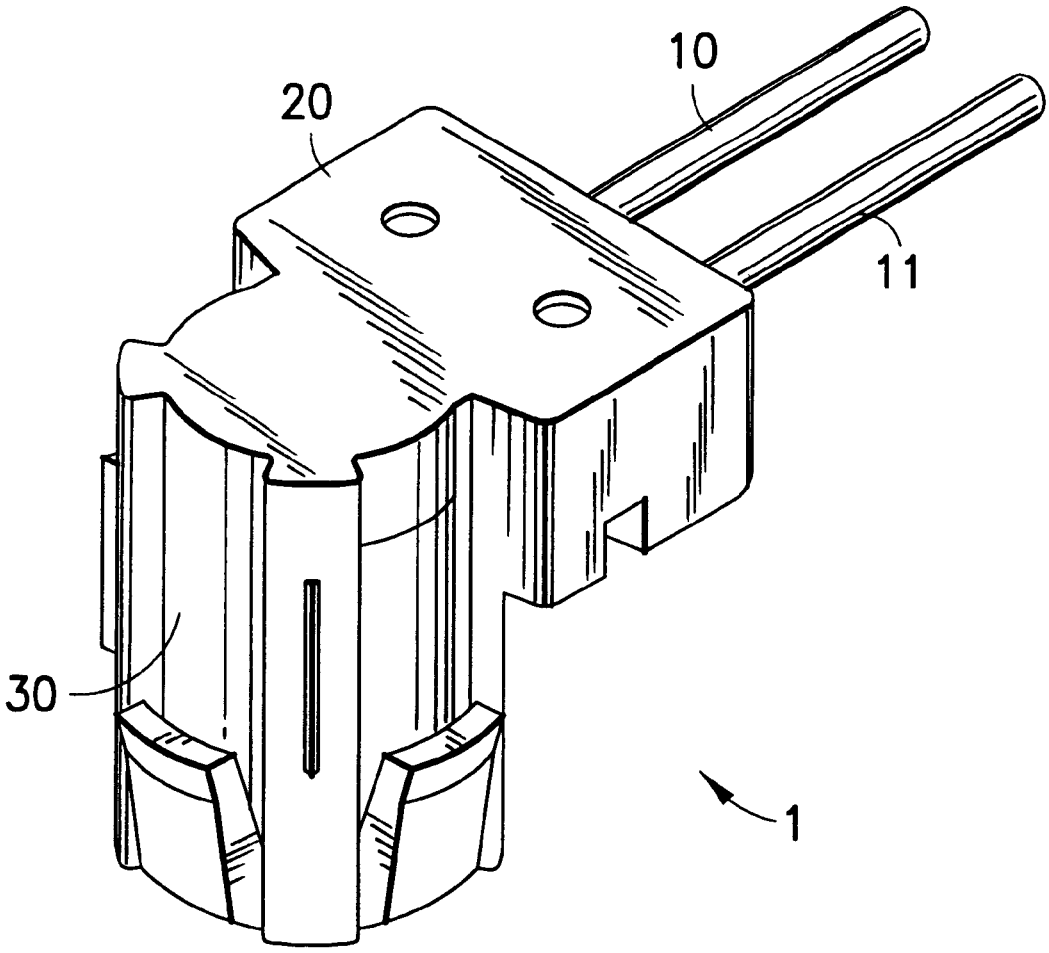
FIG. 1 is a perspective view showing a connector and portions of leads connecting to an electrical fuse ignition device according to the present invention.

FIG. 1 is a perspective view showing the outer appearance of a connector 1 according to the present invention. The connector 1 comprises a roughly cylindrical connector trunk portion housing portion 30 and a ferrite member housing portion 20 provided in the vicinity of one end of the connector trunk portion housing portion 30. The drawing shows how the ignition leads 10, 11 protrude from the ferrite member housing portion 20 roughly perpendicular to the axial direction of the connector trunk portion housing portion 30. While the ignition leads 10, 11 are partially omitted from the drawings, they extend further to eventually reach the electrical fuse ignition device. A pair of leads (not shown) are inserted from the bottom direction of the drawing into the connector 1 in the axial direction thereof, these leads being connected to the vehicle electrical system and supplying an ignition current to the electrical fuse when necessary.

Figure 2:
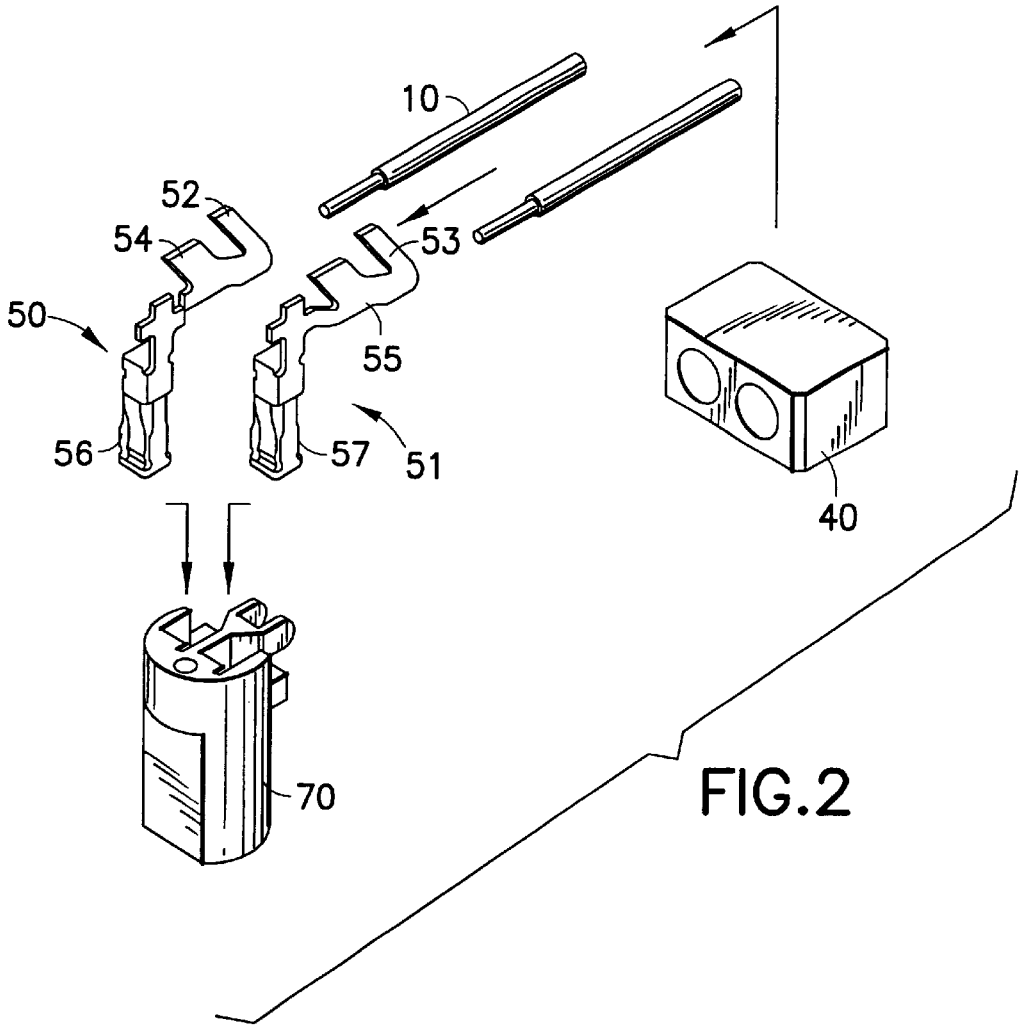
FIG. 2 is an exploded perspective view showing schematically the inside of a connector and leads.

FIG. 2 is an exploded perspective view showing the inside of the connector 1 shown in FIG. 1. The inside of the connector trunk portion housing portion 30 houses a similarly roughly cylindrical connector trunk portion 70, the connector trunk portion 70 having formed therein a pair of axially-aligned holes (through holes) extending in the axial direction. The axially-aligned holes accommodate the electrical system connecting portions 56, 57 of a pair of connector conductors 50, 51, such as electrical contacts or electrical contact elements (made of sheet metal). each having an electrical system connecting portion 56, 57 in the plug portion adapted to mate with contacts of the vehicle electrical system and a lead gripping portion which is bent roughly perpendicular thereto, the lead gripping portions protruding from an upper end portion of the connector trunk portion 70 roughly perpendicular to the electrical system connecting portions 56, 57 and therefore roughly perpendicular to the connector trunk portion 70.

At the top portion of the connector trunk portion 70, a projecting portion 60 is formed unitarily with the connector trunk portion 70 at a position between the inserted connector conductors 50, 51.

The pair of lead gripping portions are connected to the ignition leads 10, 11, and the lead gripping portions and the area around the end portions of the wires gripped by the lead gripping portions are housed inside a pair of through holes provided in the ferrite member 40. As the material for the connector conductors 50, 51, a metal such as copper having both conductivity and flexibility should be used. Two flexible claws 52, 53, 54, 55 are formed on each connector conductor 50, 51 in the vicinity of the end portion closer to the ignition leads 10, 11 in FIG. 2. These flexible claws 52, 53, 54, 55 are such that 52 and 53 grip their corresponding leads from over their sheaths, while 54 and 55 directly contact the conductors exposed from the sheaths of the corresponding leads.

Figure 3:
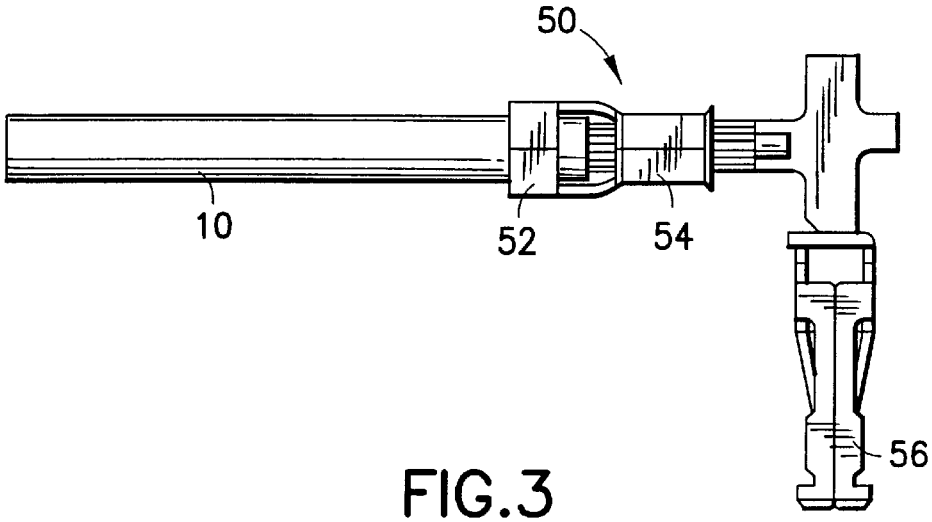
FIG. 3 is a side view showing the state of coupling of a connector conductor with a lead connected to an electrical fuse ignition device.

FIG. 3 shows, from a side view, a state where the flexible claws 52, 53, 54, 55 are respectively bent so that the connector conductors 50, 51 grip and are in electrical contact with the ignition leads 10, 11. The free end of the flexible claw 52 of the connector conductor 50 is folded around to firmly grip the insulating sheath of the ignition lead 10, while the flexible claw 54 grips the conductor exposed from the insulating sheath to achieve electrical contact. The ignition lead 10 extends roughly perpendicular to the electrical system connecting portion 56.

Figure 4:
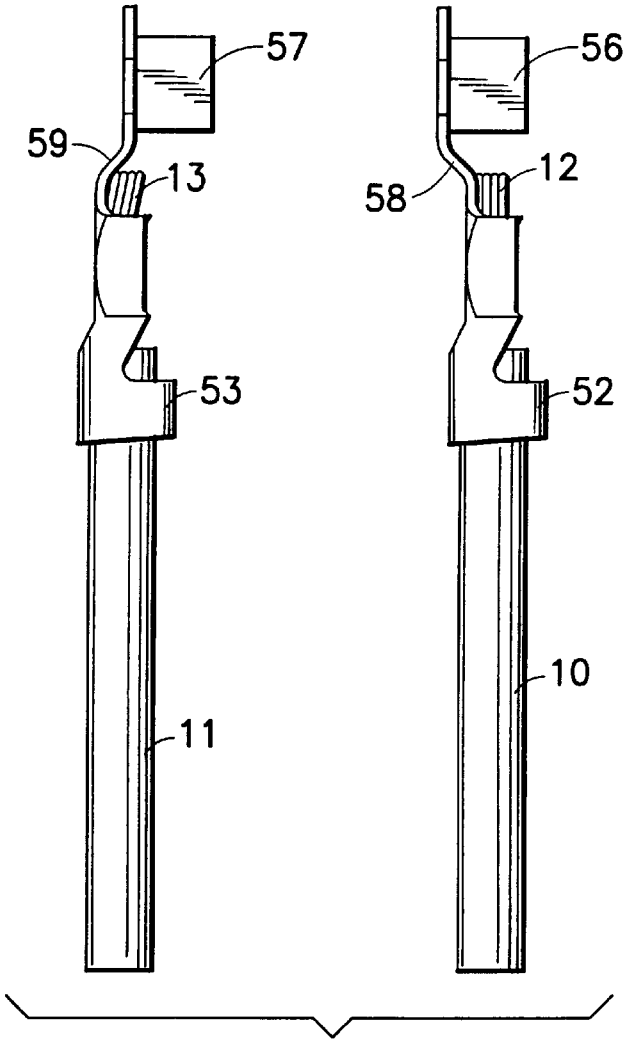
FIG. 4 is a plan view showing the state of coupling of connector conductors with leads connected to an electrical fuse ignition device.

FIG. 4 is a top plan view of a state wherein the connectors 50, 51, as in FIG. 3, grip the respectively corresponding ignition leads 10, 11 and achieve electrical contact. The flexible claws 52, 53 of the connector conductor 50, 51 grip the insulating sheaths of the ignition leads 10, 11 corresponding respectively thereto, while the flexible claws 54, 55 grip the conductors 12, 13 of the ignition leads 10, 11 to achieve electrical contact. The electrical system connecting portions 56, 57 have roughly a box shape which extends in the axial direction of the connector trunk portion 70, which is rectangular when viewed from above as shown in FIG. 4.

Here, the characteristic of the present invention is especially seen in the bent portions 58, 59. That is, the bent portion 58 of the ignition lead 10 is bent so that the connector conductor 50 will be displaced to the right in proceeding from above downward in the drawing of FIG. 4, whereas the bent portion 59 of the ignition lead 11 is bent so that the connector conductor 51 will be displaced to the left in proceeding from above downward in the drawing. Consequently, the distance between the ignition lead 10 and ignition lead It will be greater than the distance between the electrical system connecting portions 56 and 57.

Figure 5:
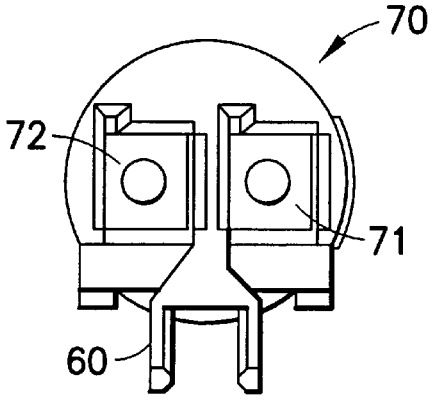
FIG. 5 is a plan view showing a connector trunk portion.

FIG. 5 is a top view of the connector trunk portion 70. While a pair of axially-aligned holes 71, 72 are provided along the axial direction of the connector trunk portion 70, the horizontal sectional shapes of these axially-aligned holes 71, 72 are roughly square in the upper portion and roughly circular in the lower portion. The electrical system connecting portions 56, 57 of the connector conductors 50, 51 are inserted into these axially-aligned holes 71, 72 from above, and the end portions of leads connecting to the vehicle electrical system are inserted from below, such that the end portions of copper wires connecting to the electrical system are inserted into the corresponding electrical system connecting portions 56, 57 and supported inside the connector trunk portion 70.

Figure 6:
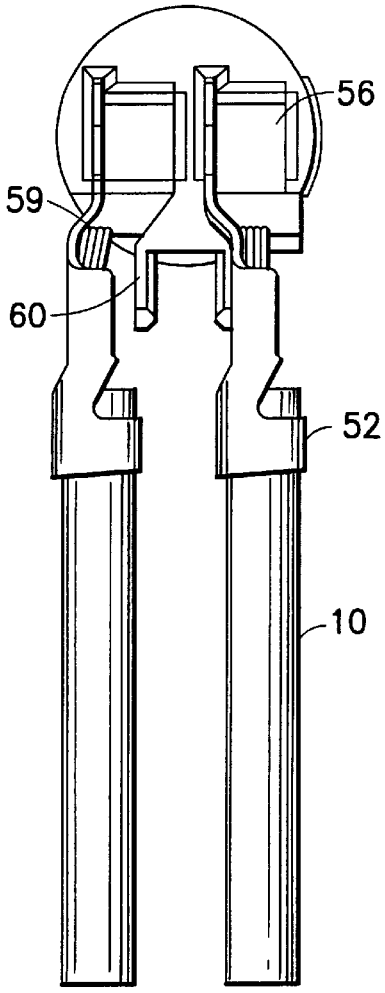
FIG. 6 is a plan view showing connector conductors in a state of insertion into a connector trunk portion along with leads connected to an electrical fuse ignition device gripped by the connector conductors.

FIG. 6 is a plan view showing the state wherein the connector conductors 50, 51 which grip and are electrically connected to the ignition leads 10, 11 are inserted inside the connector trunk portion 70. As seen in the drawing, in this state, the distance between ignition leads 10, 11 is larger than the distance between axially-aligned holes 71, 72.

Furthermore, while a projecting portion 60 lies between the connector conductors 50, 51, the connector trunk portions 50, 51 have bent portions 58, 59, and the gap therebetween is wider than the gap between the axially-aligned holes provided in the connector trunk portions 50, 51, so that the projecting portion 60 does not interfere with the connector conductors. That is, if an attempt is made to insert the connector conductors into the axially-aligned holes with right and left reversed from the orientation shown in FIG. 6, the projecting portion 60 will interfere and make them impossible to insert. That is, the projecting portion 60, together with the shapes of the connector conductors 50, 51 having bent portions, will work to prevent erroneous insertion. The projecting portion 60 is shaped so as to guide and separate an intermediate section of the connector conductors 50,51.

Figure 7:
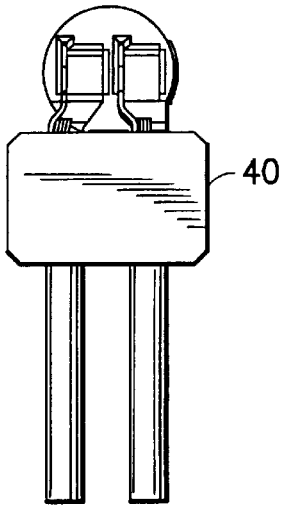
FIG. 7 is a plan view showing a ferrite member attached to the connector conductors and leads.

FIG. 7 is a top plan view showing the ferrite member 40 for protecting the leads from external electromagnetic noise set in a predetermined position. The ferrite member 40 is provided with two through holes in the direction of extension of the ignition leads 10, 11, and the ignition leads 10, 11 are accommodated inside the corresponding through holes of the ferrite member 40 together with the gripping portions of the connector conductors 50, 51 which respectively grip them.

What is important here is that the distance between the pair of through holes provided in the ferrite member 40 corresponds to the distance between the ignition leads 10, 11 held by the connector conductors 50, 51 inserted into the axially-aligned holes 71, 72 as shown in FIG. 7. Due thereto, only ignition leads 10, 11 and connector conductors 50, 51 which have been assembled correctly are able to be accommodated into the ferrite member 40. If the connector conductors 50, 51 are inserted into respectively reversed axially-aligned holes 72, 71, then the bent portions 58, 59 of the connector conductors 50, 51 will cause the distance between the ignition leads 10, 11 to become smaller than a predetermined distance, thus making it impossible to accommodate the ignition lines 10, 11 and connector conductors 50, 51 inside the ferrite member 40. In this way, the possibility of coupling the leads in a mistaken manner is eliminated.

Figure 8:
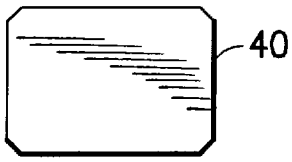
FIG. 8 is a plan view showing a ferrite member.
Figure 9:
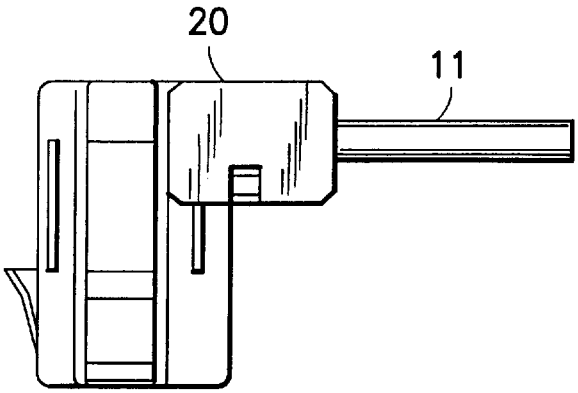
FIG. 9 is a side view showing a connector and a portion of a lead connected to an electrical fuse ignition device according to the present invention.
Figure 10:
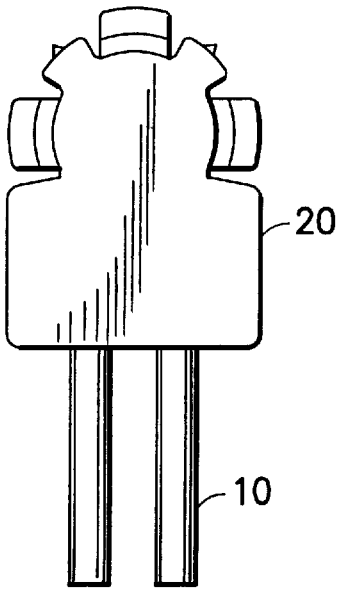
FIG. 10 is a plan view showing a connector and portions of leads connected to an electrical fuse ignition device according to the present invention.

In FIG. 8, the ferrite member 40 is shown by itself. FIGS. 9 and 10 show a side view and plan view of a connector which has been completely assembled, with the exception that the connection to the electrical system has not been made.

| Explanation of Reference Numerals | |
|---|---|
| 1 | connector |
| 10, 11 | lead |
| 20 | ferrite member housing portion |
| 30 | connector trunk portion housing portion |
| 40 | ferrite member |
| 50, 51 | connector conductor |
| 52, 53, 54, 55 | flexible claw |
| 56, 57 | electrical system connecting portion |
| 60 | projecting portion |
| 70 | connector trunk portion |

What is claimed is:

1. A connector for an electrical fuse ignition device comprising a pair of connector conductors adapted to grip a pair of leads; a ferrite member having a pair of through holes for accommodating the vicinities of one end of the pair of connector conductors; and a connector trunk portion having a pair of axially-aligned holes for accommodating the vicinities of the other end of the connector conductors, the connector being characterized in that the shapes of said pair of connector conductors are non-identical such that the distance between the leads gripped when the other ends of said connector conductors are inserted into the axially-aligned holes of the connector trunk portion is different from the distance between said axially-aligned holes; and the distance between the pair of through holes provided in said ferrite member is roughly equal to the distance between the leads when the connector conductors are inserted into the axially-aligned holes of said connector trunk portion.

2. A connector as recited in claim 1 wherein said pair of connector conductors maintain the distance between gripped leads larger than the distance between said axially-oriented holes.

3. A connector as recited in claim 1, wherein said pair of connector conductors are such that the axial direction of the pair of gripped leads is roughly perpendicular to the direction of the other end portion housed in the connector trunk portion.

4. A connector as recited in claim 1, wherein said pair of connector conductors form a housing portion capable of accommodating the free ends of another pair of leads in the vicinities of said other ends.

5. A connector as recited in claim 1, wherein said connector trunk portion is provided with a projecting portion at a position near mouth portions of the axially-oriented holes such as to interfere with connector conductors of which insertion is attempted into the wrong axially-oriented holes in order to make insertion difficult.

6. A connector as recited in claim 1, wherein the pair of connector conductors, the ferrite member and the connector trunk portion are further accommodated in a casing.

7. A connector as recited in claim 1, wherein said connector conductors grip leads connecting to the electrical fuse ignition device, and also connect with power cables connecting to a power system at said other end portions.

8. A connector for an electrical fuse ignition device comprising a pair of connector conductors adapted to grip a pair of leads; a ferrite member having a pair of through holes for accommodating the vicinities of one end of the pair of connector conductors; and a connector trunk portion having a pair of axially-aligned holes for accommodating the vicinities of the other end of the connector conductors, the connector being characterized in that the shapes of said pair of connector conductors are non-identical such that the distance between the leads gripped when the other ends of said connector conductors are inserted into the axially-aligned holes of the connector trunk portion is different from the distance between said axially-aligned holes; and the distance between the pair of through holes provided in said ferrite member is roughly equal to the distance between the leads when the connector conductors are inserted into the axially-aligned holes of said connector trunk portion, said electrical fuse ignition device comprising an airbag gas-filling device.

9. A connector as recited in claim 8, wherein said airbag is an automobile airbag.

10. A connector as recited in claim 1, which is a universal-type capable of being adapted to both pig-tail type and pin type connections.

11. A connector as recited in claim 1 wherein the pair of connector conductors comprises a first conductor having a portion bent in one direction and a second conductor having a portion bent in an opposing direction so that a gap between the bent portions of the connector conductors when the connector conductors are inserted in the trunk portion is wider than a gap between the axially-aligned holes.

12. A connector as recited in claim 11 further including a projecting portion from said trunk portion arranged to extend between the connector conductors for interacting with the bent portions of the connector conductors for preventing incorrect insertion of the connector conductors into the axially-aligned holes of the connector trunk portion.

13. A connector for an electrical fuse ignition device comprising a pair of electrical contacts adapted to grip a pair of leads; a ferrite member having a pair of through holes for accommodating the vicinities of one end of the pair of electrical contacts; and a connector trunk portion having a pair of axially-aligned holes for accommodating the vicinities of the other end of the electrical contacts, the connector being characterized in that the shapes of said pair of electrical contacts are non-identical such that the distance between the leads gripped when the other ends of said electrical contacts are inserted into the axially-aligned holes of the connector trunk portion is different from the distance between said axially-aligned holes; and the distance between the pair of through holes provided in said ferrite member is roughly equal to the distance between the leads when the electrical contacts are inserted into the axially-aligned holes of said connector trunk portion.

14. A connector as recited in claim 13 wherein said pair of electrical contacts maintain the distance between gripped leads larger than the distance between said axially-oriented holes.

15. A connector as recited in claim 13, wherein said pair of electrical contacts are such that the axial direction of the pair of gripped leads is roughly perpendicular to the direction of the other end portion housed in the connector trunk portion.

16. A connector as recited in claim 13, wherein said pair of electrical contacts form a housing portion capable of accommodating the free ends of another pair of leads in the vicinities of said other ends.

17. A connector as recited in claim 13, wherein said connector trunk portion is provided with a projecting portion at a position near mouth portions of the axially-oriented holes such as to interfere with electrical contacts of which insertion is attempted into the wrong axially-oriented holes in order to make insertion difficult.

18. A connector as recited in claim 13, wherein the pair of electrical contacts, the ferrite member and the connector trunk portion are further accommodated in a casing.

19. A connector as recited in claim 13, wherein said electrical contacts grip leads connecting to the electrical fuse ignition device, and also connect with power cables connecting to a power system at said other end portions.

20. A connector as recited in claim 13, wherein said electrical fuse ignition device is an airbag gas-filling device.

21. A connector as recited in claim 20, wherein said airbag is an automobile airbag.

22. A connector as recited in any one of claims 13, which is a universal-type capable of being adapted to both pig-tail type and pin type connections.

23. Igniter device plug connector of an angled type having a trunk portion provided with axially aligned holes receiving a mating side of two electrical contact elements, the plug connector further comprising a wire receiving section receiving a first connection end of said electrical contact elements, said first connection end of said contact elements being adapted to grip a wire, said trunk portion and said wire receiving section being angled relative to each other, said trunk portion comprising at least one projection located within said wire receiving section, said projection being shaped so as to guide and separate an intermediate section of said at least two electrical contact elements.

24. Igniter device plug connector as recited in claim 23 wherein said wire receiving section further receives a ferrite element provided with a pair of through holes through which said wires extend.

25. Igniter device plug connector as recited in claim 24 wherein the distance between said axially aligned holes is smaller than the distance between said pair of through holes.

26. Igniter device plug connector as recited in claim 24 wherein said wire receiving section is part of a casing, said casing having a portion accommodating said trunk portion.

* * * * *